US007459988B1

(12) United States Patent
Iversen

(10) Patent No.: US 7,459,988 B1
(45) Date of Patent: Dec. 2, 2008

(54) HIGH LINEARITY WIDE DYNAMIC RANGE RADIO FREQUENCY ANTENNA SWITCH

(75) Inventor: Christian Rye Iversen, Vestbjerg (DK)

(73) Assignee: RF Micro Devices, Inc., Greensboro, NC (US)

( * ) Notice: Subject to any disclaimer, the term of this patent is extended or adjusted under 35 U.S.C. 154(b) by 254 days.

(21) Appl. No.: 11/532,725

(22) Filed: Sep. 18, 2006

(51) Int. Cl.
*H01P 1/10* (2006.01)

(52) U.S. Cl. ..... 333/103; 333/262; 327/430

(58) Field of Classification Search ..... 333/101, 333/103, 262
See application file for complete search history.

(56) References Cited

U.S. PATENT DOCUMENTS 6,218,890 B1 * 4/2001 Yamaguchi et al. ..... 327/427
6,730,953 B2 5/2004 Brindle et al.
6,803,680 B2 10/2004 Brindle et al.
6,882,210 B2 4/2005 Asano et al.
6,891,909 B2 5/2005 Hurley et al.
6,900,711 B2 * 5/2005 Vice ..... 333/262
6,903,656 B1 6/2005 Lee
7,106,121 B2 * 9/2006 Hidaka et al. ..... 327/308
7,199,635 B2 * 4/2007 Nakatsuka et al. ..... 327/308

* cited by examiner

*Primary Examiner*—Benny Lee
*Assistant Examiner*—Alan Wong
(74) *Attorney, Agent, or Firm*—Withrow & Terranova, P.L.L.C.

(57) ABSTRACT

The present invention is a wide dynamic range antenna switch that, when disabled, has a stable input impedance over a wide power range. The wide dynamic range antenna switch includes multiple transistors, which are coupled in series, to provide a main signal path between an antenna connection and a radio connection. Direct current (DC) bias signals are provided to each of the transistors to ensure than when the antenna switch is disabled, the input impedance is stable. A control input, which may operate with low voltage control signals, enables or disables the antenna switch. The antenna switch may be coupled with other antenna switches in a communications system with multiple transceivers sharing a common antenna, and with a wide range of transmitter output power levels. Different embodiments of the present invention provide different DC bias circuit architectures.

20 Claims, 19 Drawing Sheets

HIGH LINEARITY WIDE DYNAMIC RANGE RADIO FREQUENCY ANTENNA SWITCH

FIELD OF THE INVENTION

The present invention relates to radio frequency (RF) antenna switches used in RF communications systems.

BACKGROUND OF THE INVENTION

With the growth of the wireless communications industry, wireless communications systems have become more sophisticated, and may have to provide support for multiple communications protocols. One example is a system requiring support for both the Wide Band Code Division Multiple Access (WCDMA) and the Global System for Mobile Communications (GSM) communications protocols. These two protocols have significant differences such that two different RF transceivers may be needed. FIG. 1 shows a dual transceiver communications system 10 using a common antenna 12 coupled to antenna connections ANT of a first antenna switch branch 14 and a second antenna switch branch 16. A radio connection RADIO of the first antenna switch branch 14 is coupled to a first transceiver 18, which may provide support for the GSM protocol. A radio connection RADIO of the second antenna switch branch 16 is coupled to a second transceiver 20, which may provide support for the WCDMA protocol. A control system 22 selects either the GSM or the WCDMA protocol by enabling either the first antenna switch branch and transceiver 14, 18 or the second antenna switch branch and transceiver 16, 20. A control input CONTROL of the second antenna switch branch 16 receives a control signal from the control system 22. A control input CONTROL of the first antenna switch branch 14 receives the control signal from the control system 22 through an inverter 24. Therefore, when the first antenna switch branch 14 is enabled, the second antenna switch branch 16 is disabled, and vice versa. The control signal may be low voltage in the range of about 2.5 volts. The antenna switch branches 14, 16 may have similar construction.

When transmitting and receiving using the GSM protocol, the first antenna switch branch 14 is enabled and the second antenna switch branch 16 is disabled. The GSM protocol may support a transmitter output power of about +33 decibel milliwatts (dbm); therefore, the enabled first switch branch 14 must be capable of transferring +33 dbm of power to the antenna 12. The disabled second switch branch 16 must present substantially an open circuit in the presence of +33 dbm signals.

SUMMARY OF THE INVENTION

The present invention is a wide dynamic range antenna switch that, when disabled, has a stable input impedance over a wide power range. The wide dynamic range antenna switch includes multiple transistors, which are coupled in series, to provide a main signal path between an antenna connection and a radio connection. Direct current (DC) bias signals are provided to each of the transistors to ensure than when the antenna switch is disabled, the input impedance is stable. A control input, which may operate with low voltage control signals, enables or disables the antenna switch. The antenna switch may be coupled with other antenna switches in a communications system with multiple transceivers sharing a common antenna, and with a wide range of transmitter output power levels. Different embodiments of the present invention provide different DC bias circuit architectures. In certain embodiments of the present invention, the antenna switch is symmetrical so that the antenna connection and the radio connection are interchangeable.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

FIG. 1 is prior art showing a dual transceiver communications system with two antenna switches.

FIG. 2 a wide dynamic range RF antenna switch with bias circuitry receiving an input signal from an antenna connection node and a radio connection node.

FIG. 3 adds a self-biasing network to the antenna side of the wide dynamic range RF antenna switch of FIG. 2.

FIG. 4 adds a self-biasing network to the radio side of the wide dynamic range RF antenna switch of FIG. 3.

FIG. 5 adds a common control network to the wide dynamic range RF antenna switch of FIG. 4.

Figure 9:
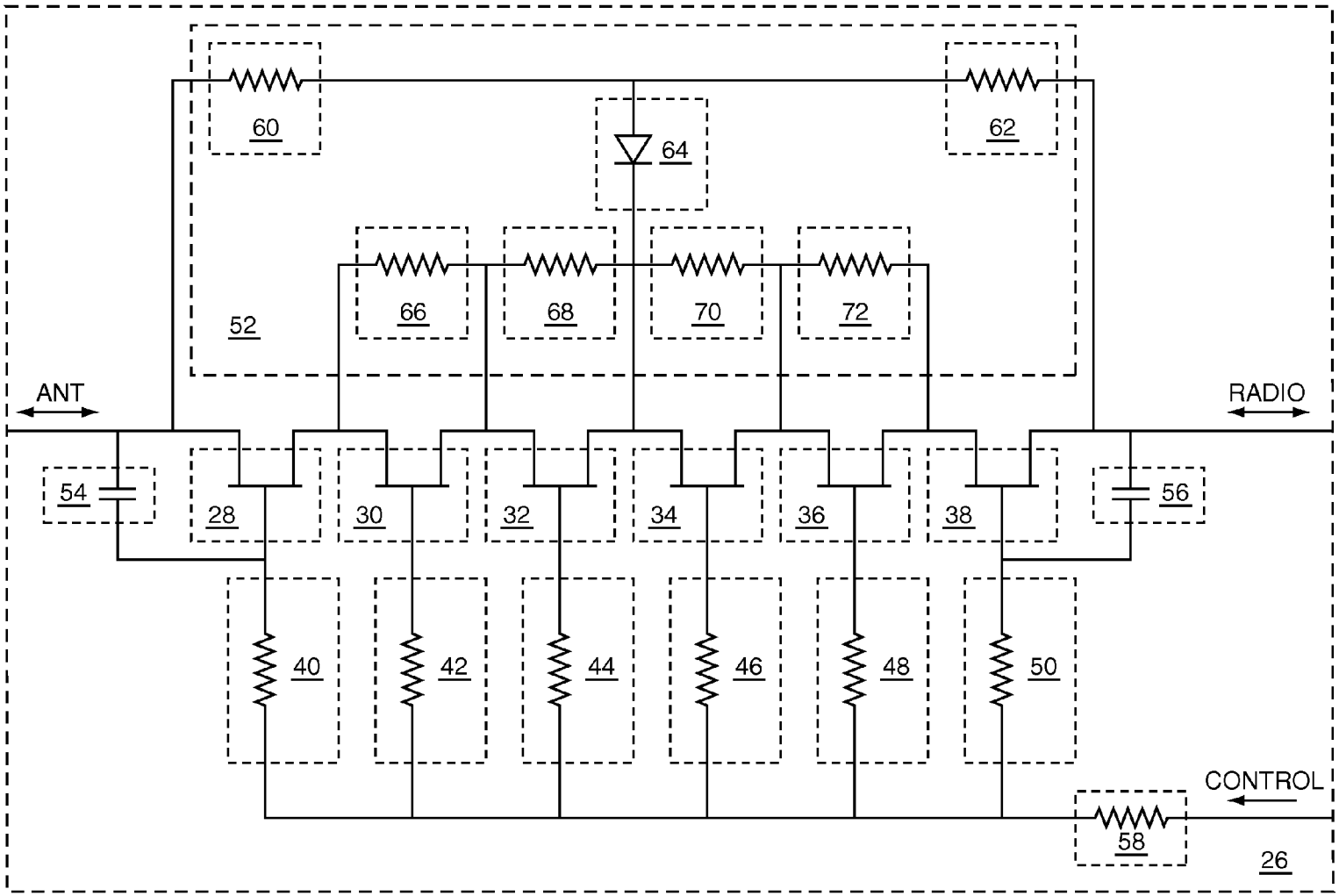
FIG. 9 shows a second embodiment of the present invention wherein the first bias circuit of FIG. 8 is a diode element.
Figure 10:
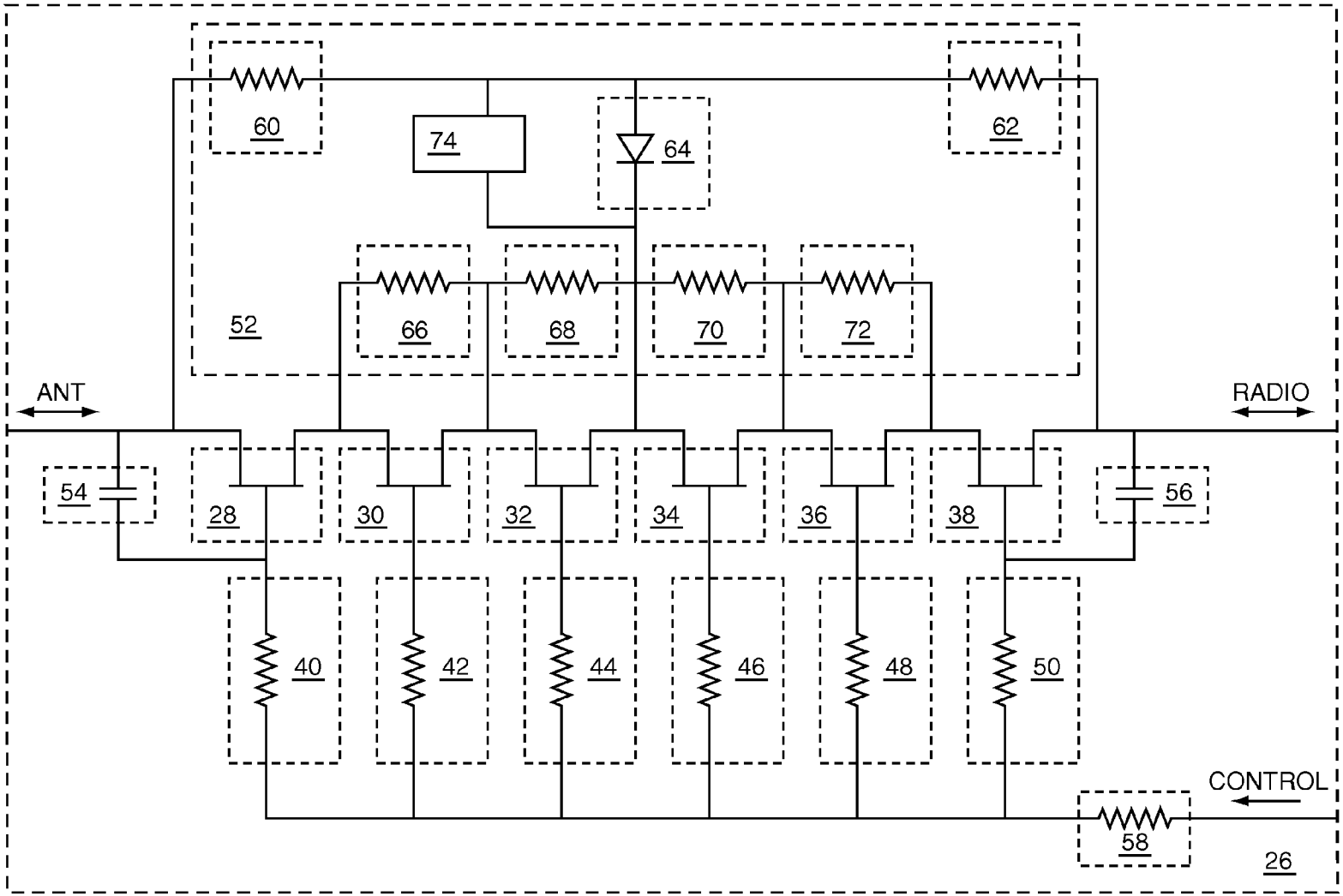

FIG. 10 adds a first RF bypass network to the second embodiment of the present invention shown in FIG. 9.

Figure 11:
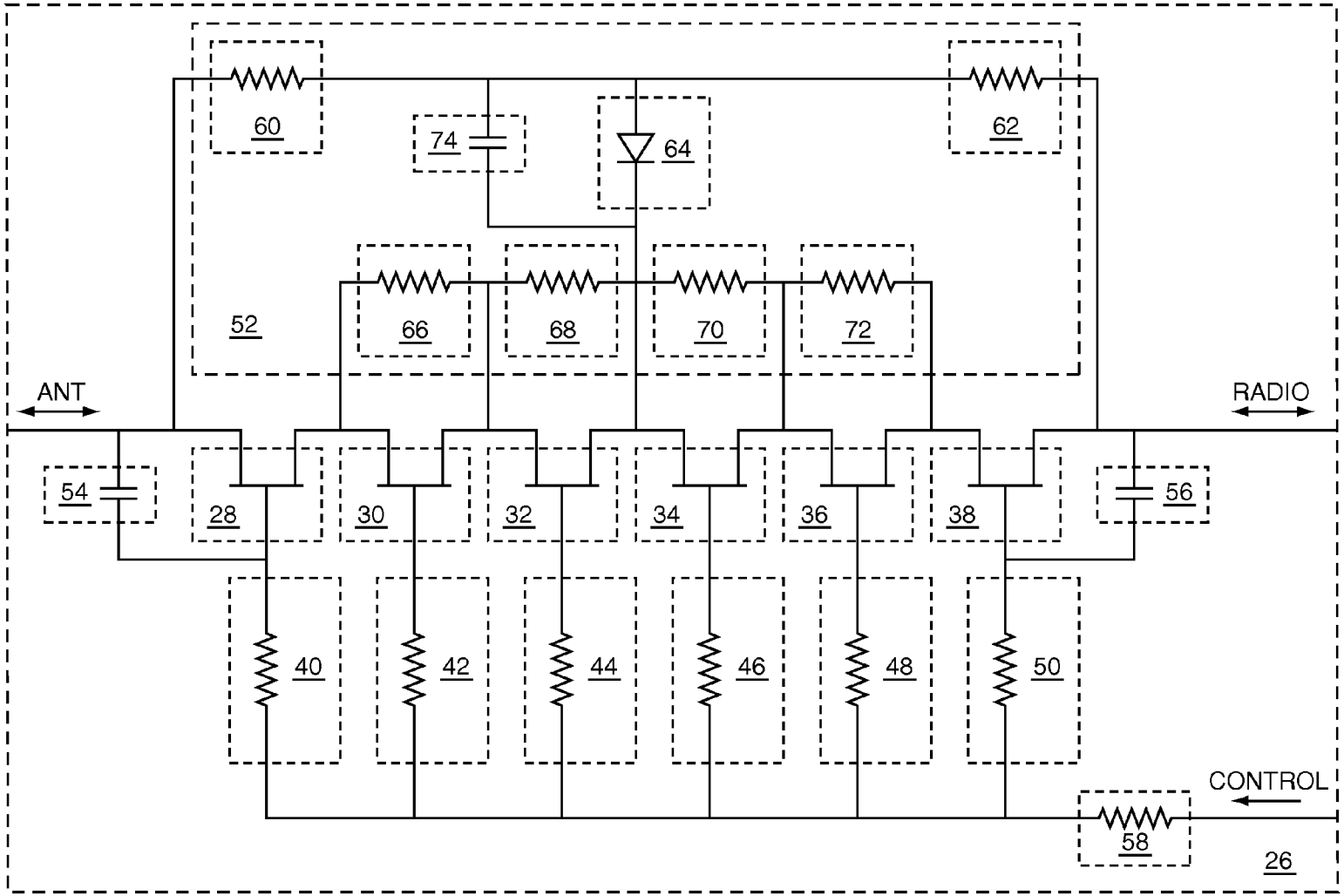

FIG. 11 shows the first RF bypass network of FIG. 10 as a capacitive element.

Figure 8:
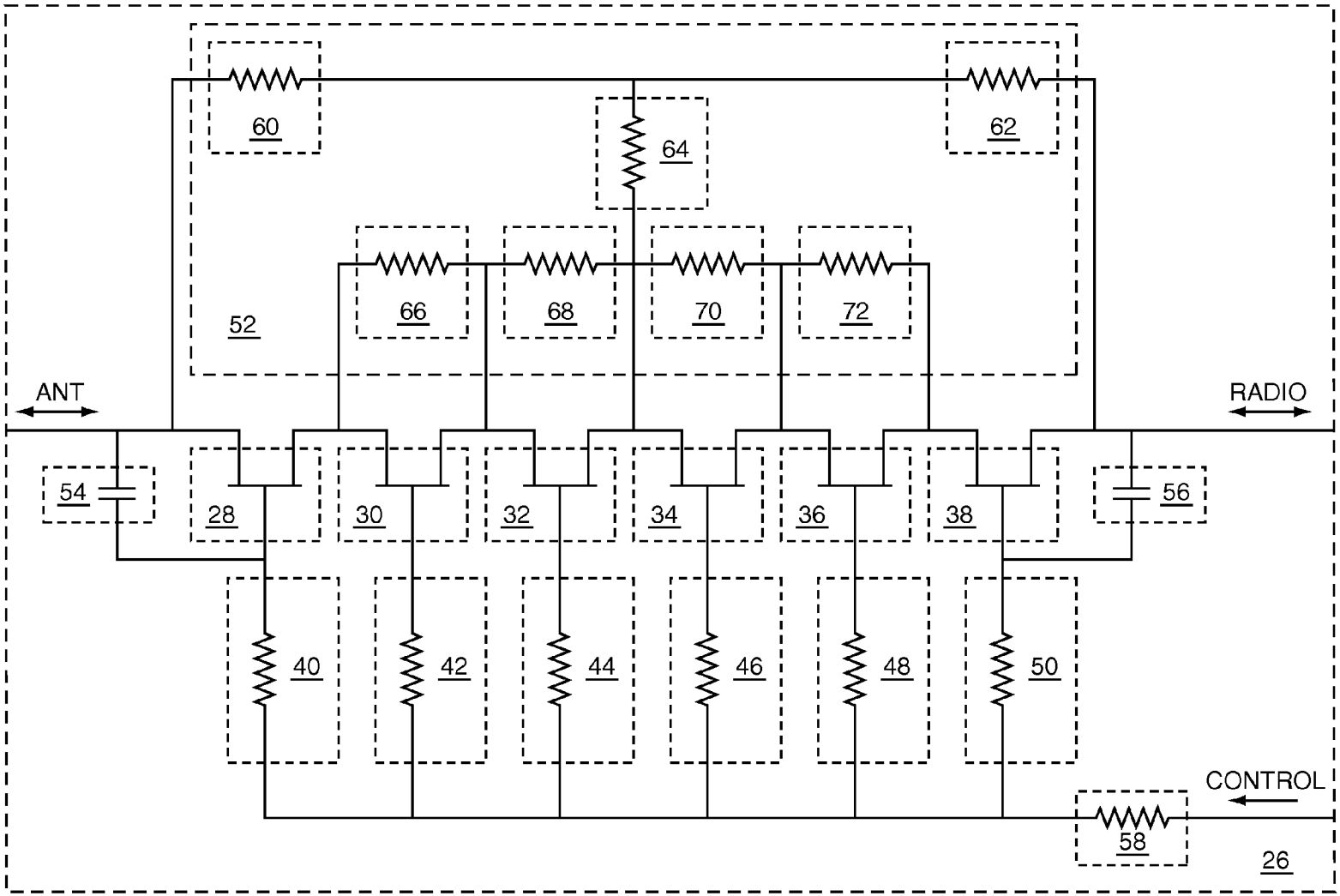
FIG. 8 shows a first embodiment of the present invention, wherein the first bias circuit of FIG. 7 is a resistive element.
Figure 12:
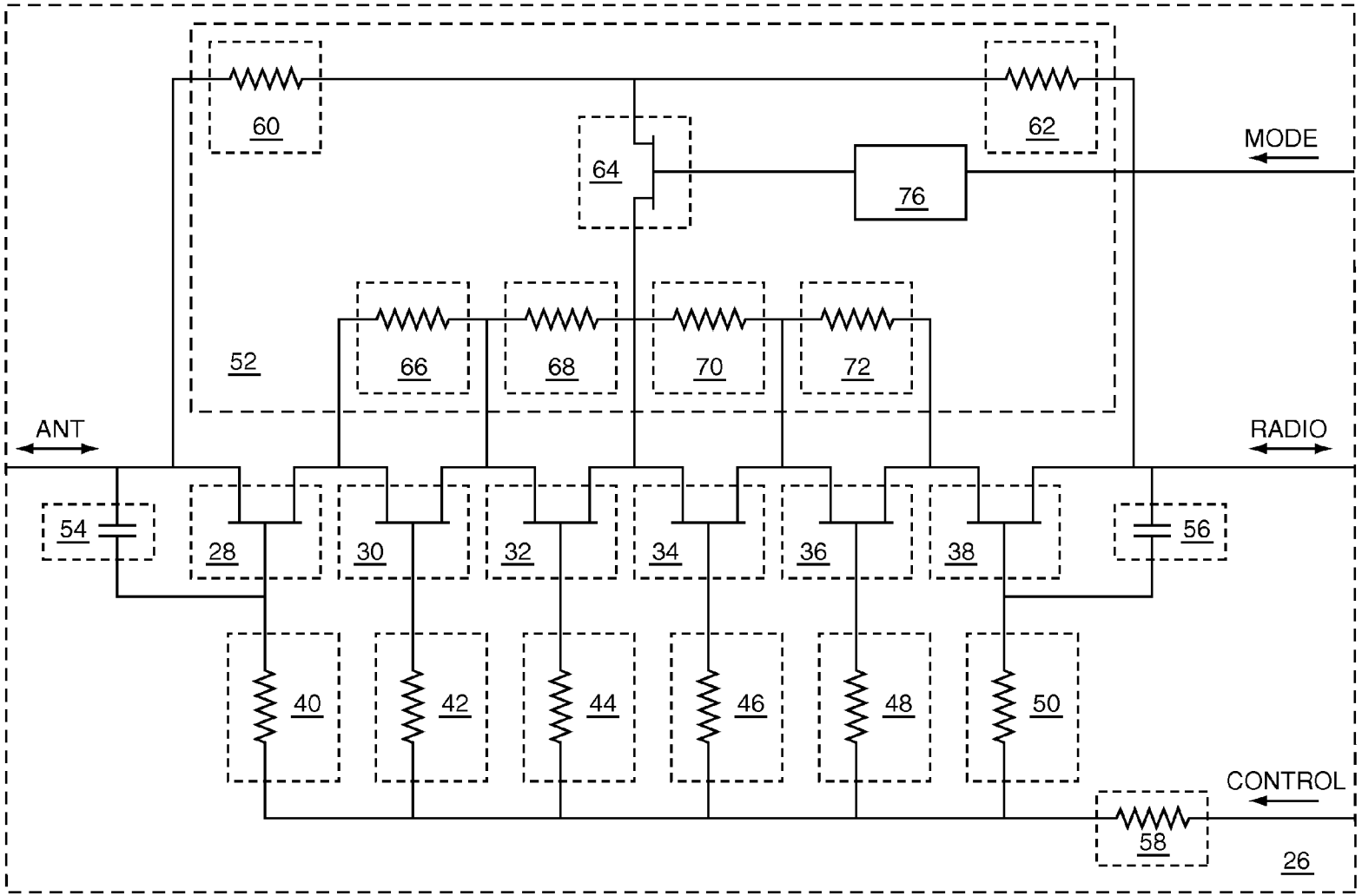

FIG. 12 shows a third embodiment of the present invention wherein the first bias circuit of FIG. 8 is a bias switching transistor element, and adds a bias switching transistor control network.

Figure 13:
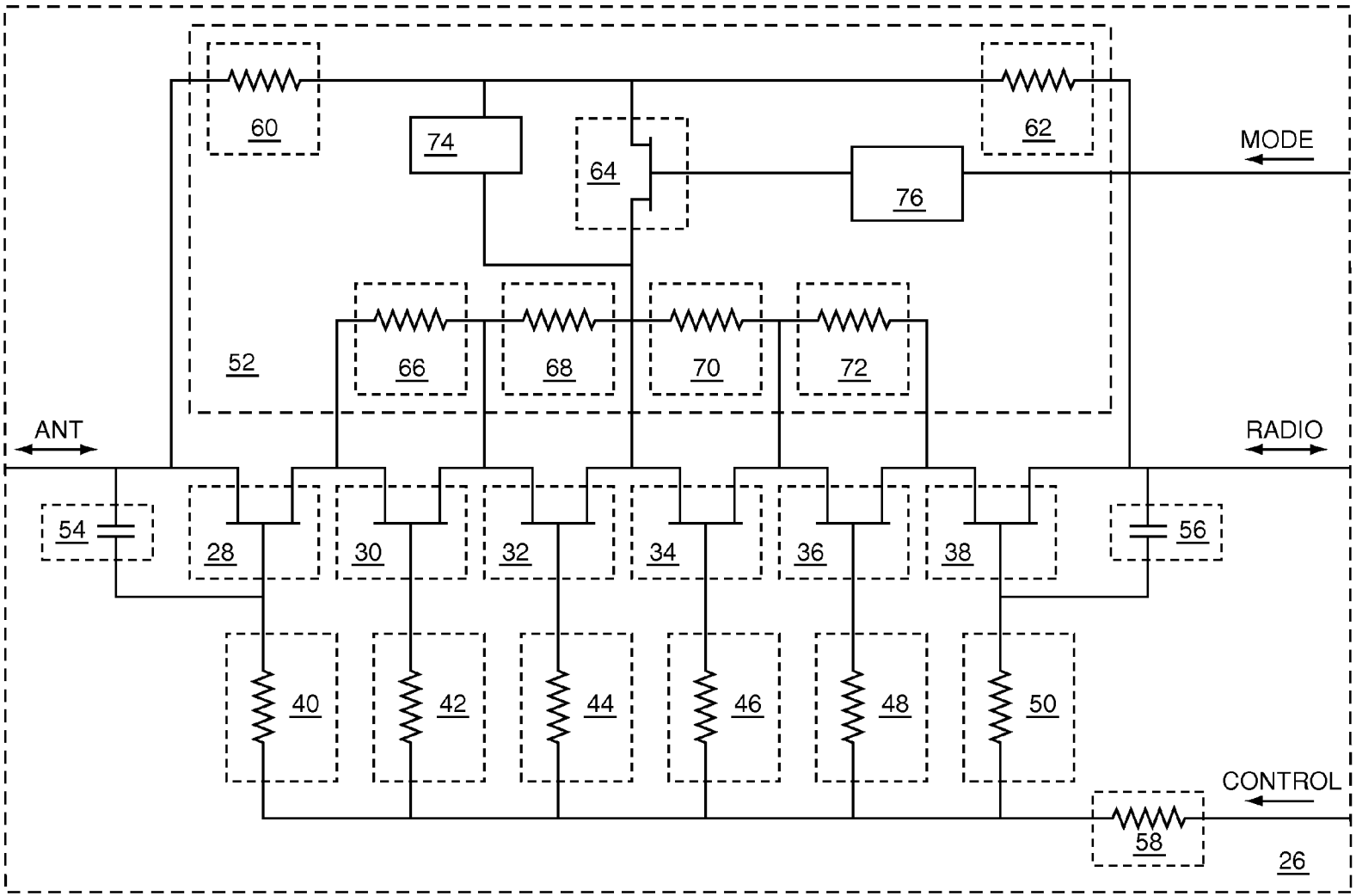

FIG. 13 adds the first RF bypass network to the third embodiment of the present invention shown in FIG. 12.

Figure 14:
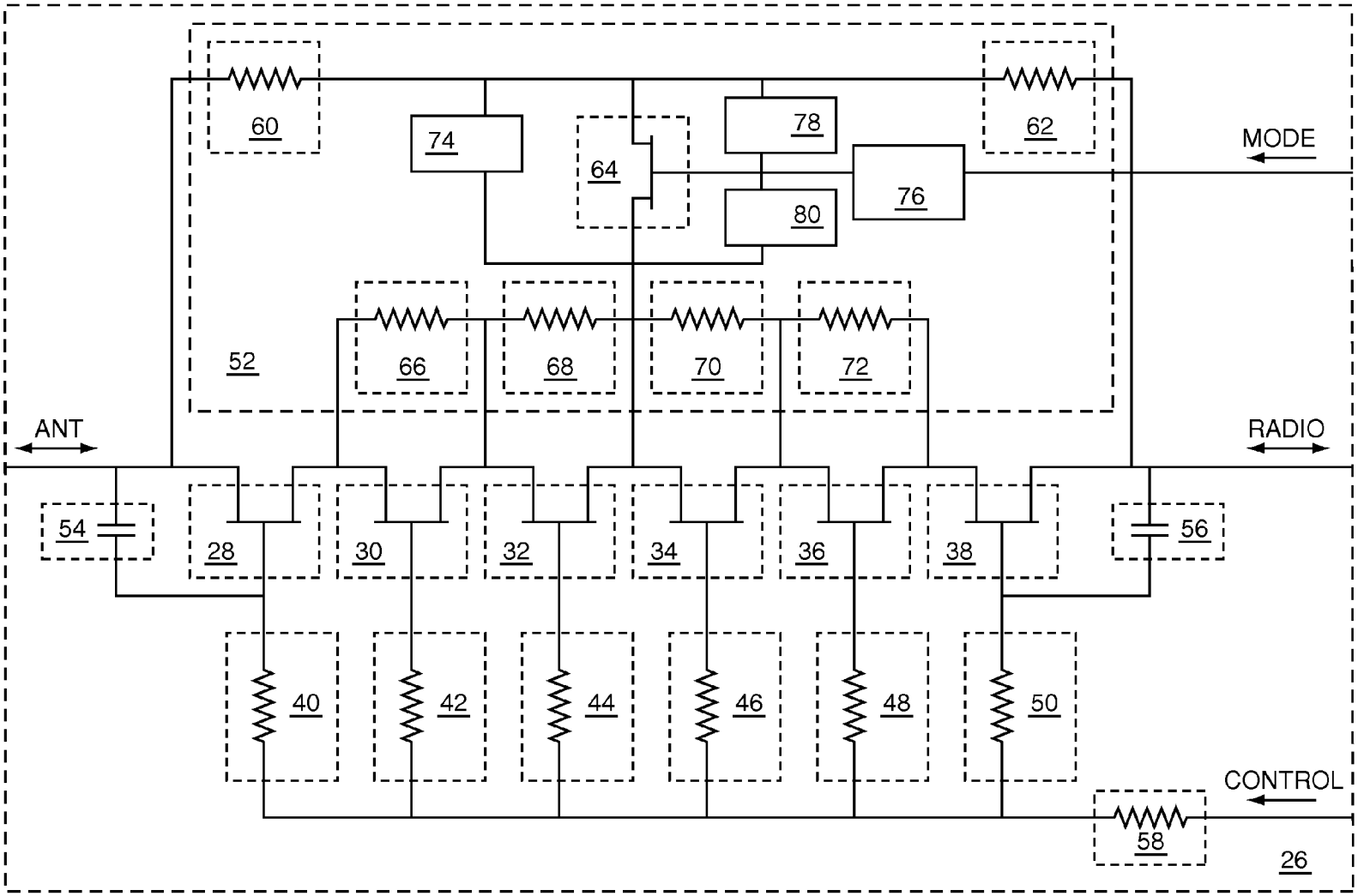

FIG. 14 adds a second RF bypass network and a third RF bypass network to the third embodiment of the present invention shown in FIG. 13.

Figure 15:
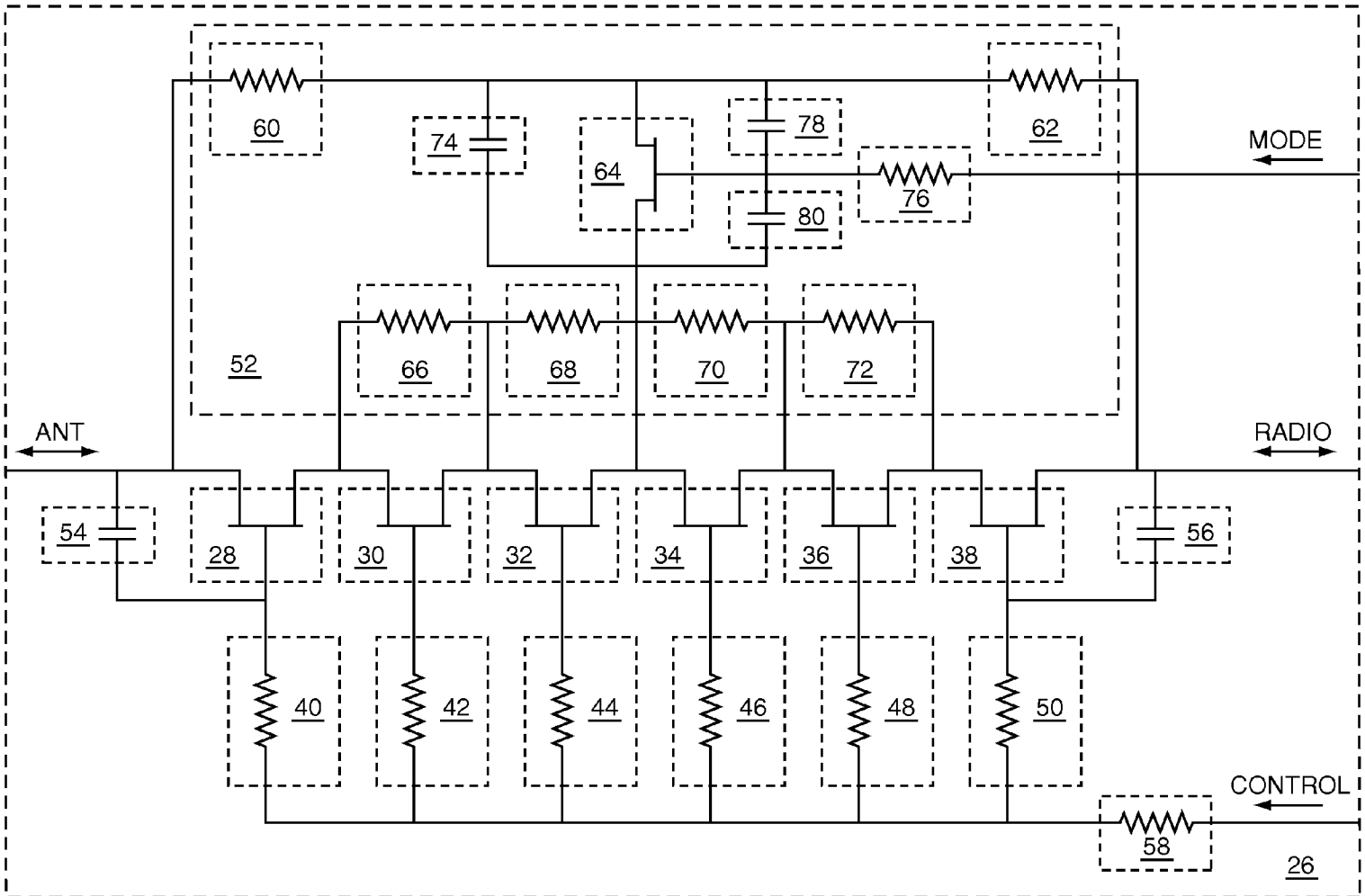

FIG. 15 shows the first, second, and third RF bypass networks of FIG. 14 as capacitive elements, and the bias switching transistor control network as a resistive element.

Figure 16:
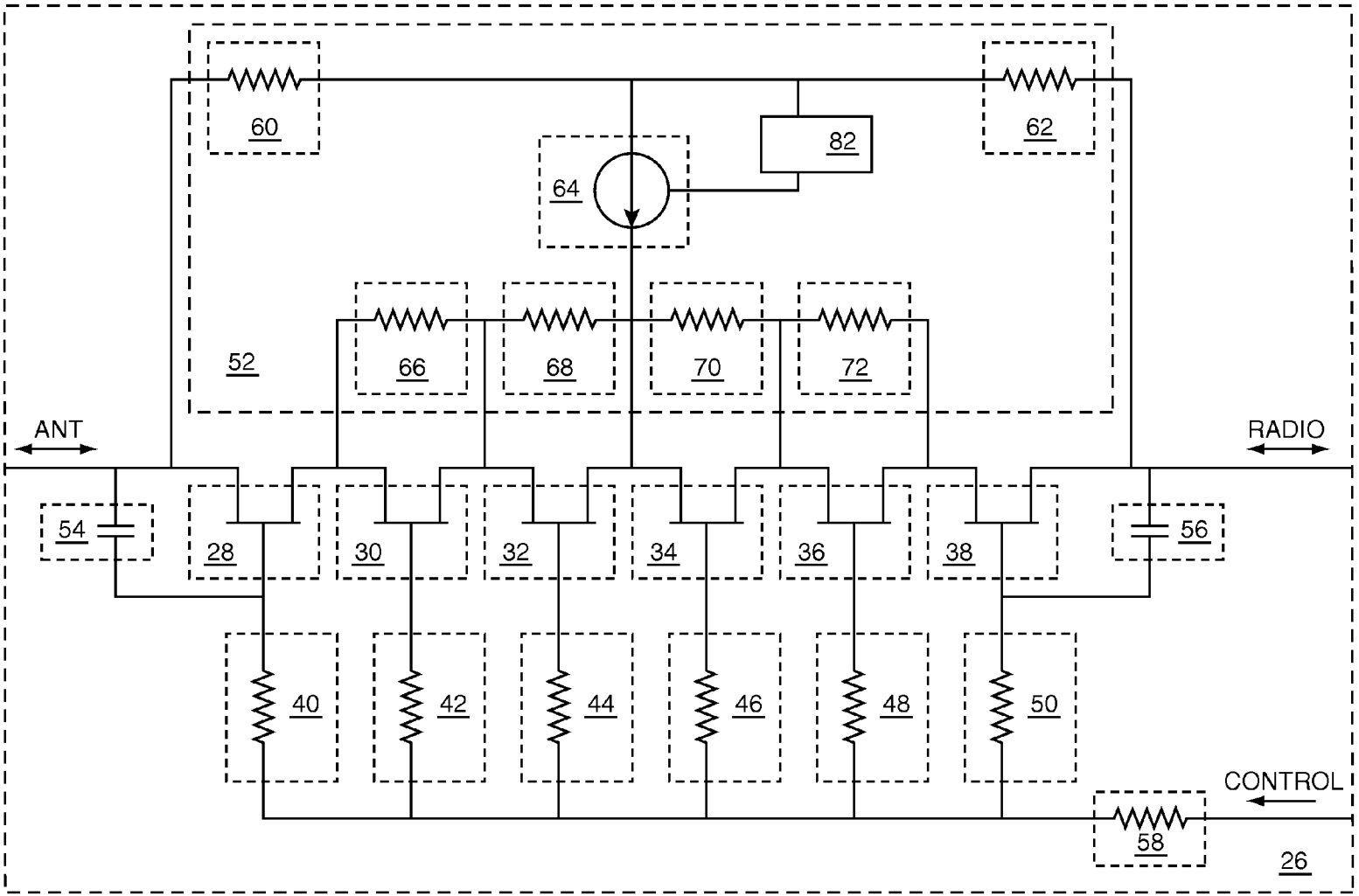

FIG. 16 shows a fourth embodiment of the present invention wherein the first bias circuit of FIG. 8 is a current source, which is coupled to a current source control network.

Figure 17:
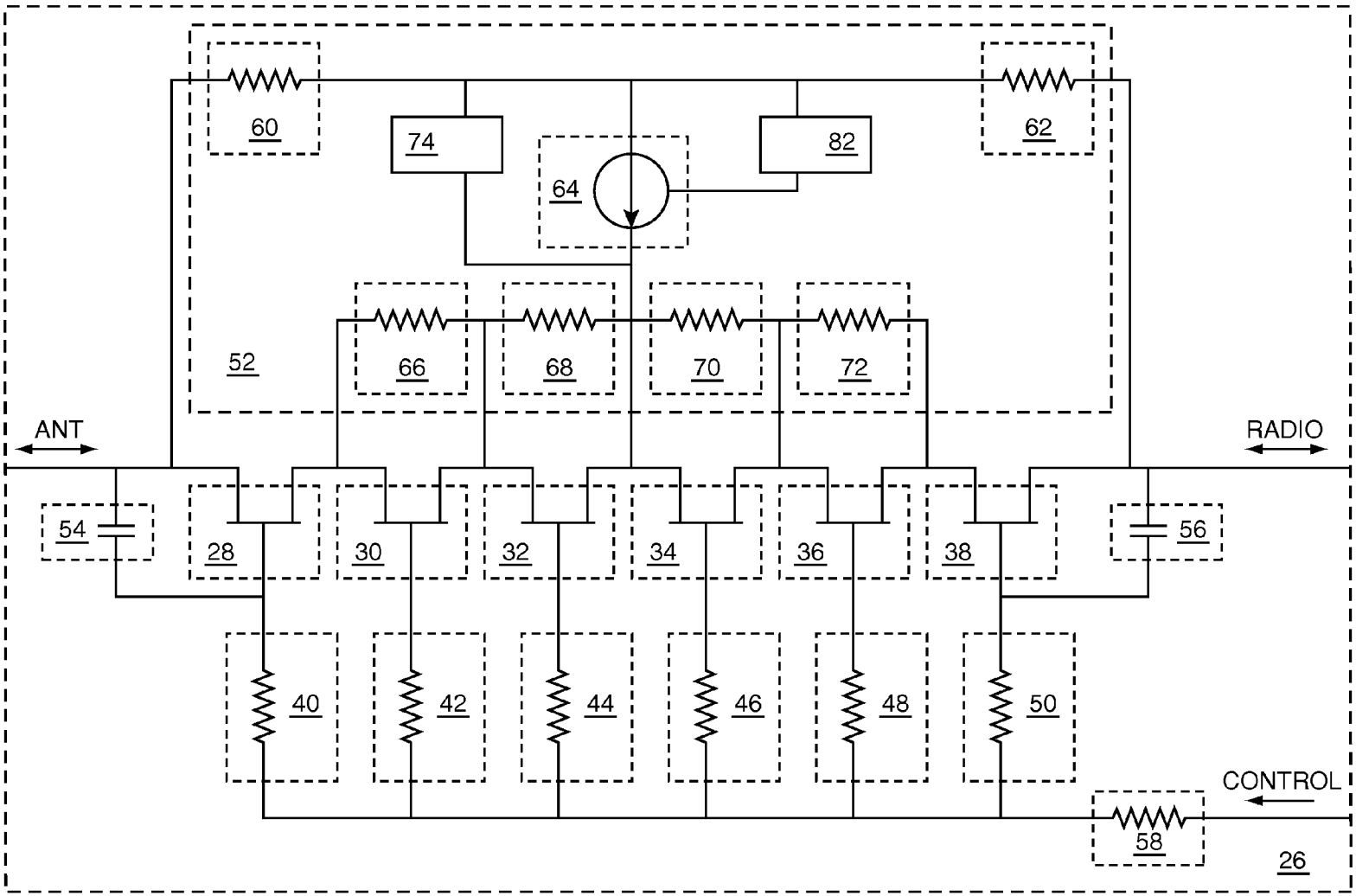

FIG. 17 adds the first RF bypass network to the fourth embodiment of the present invention shown in FIG. 16.

Figure 18:
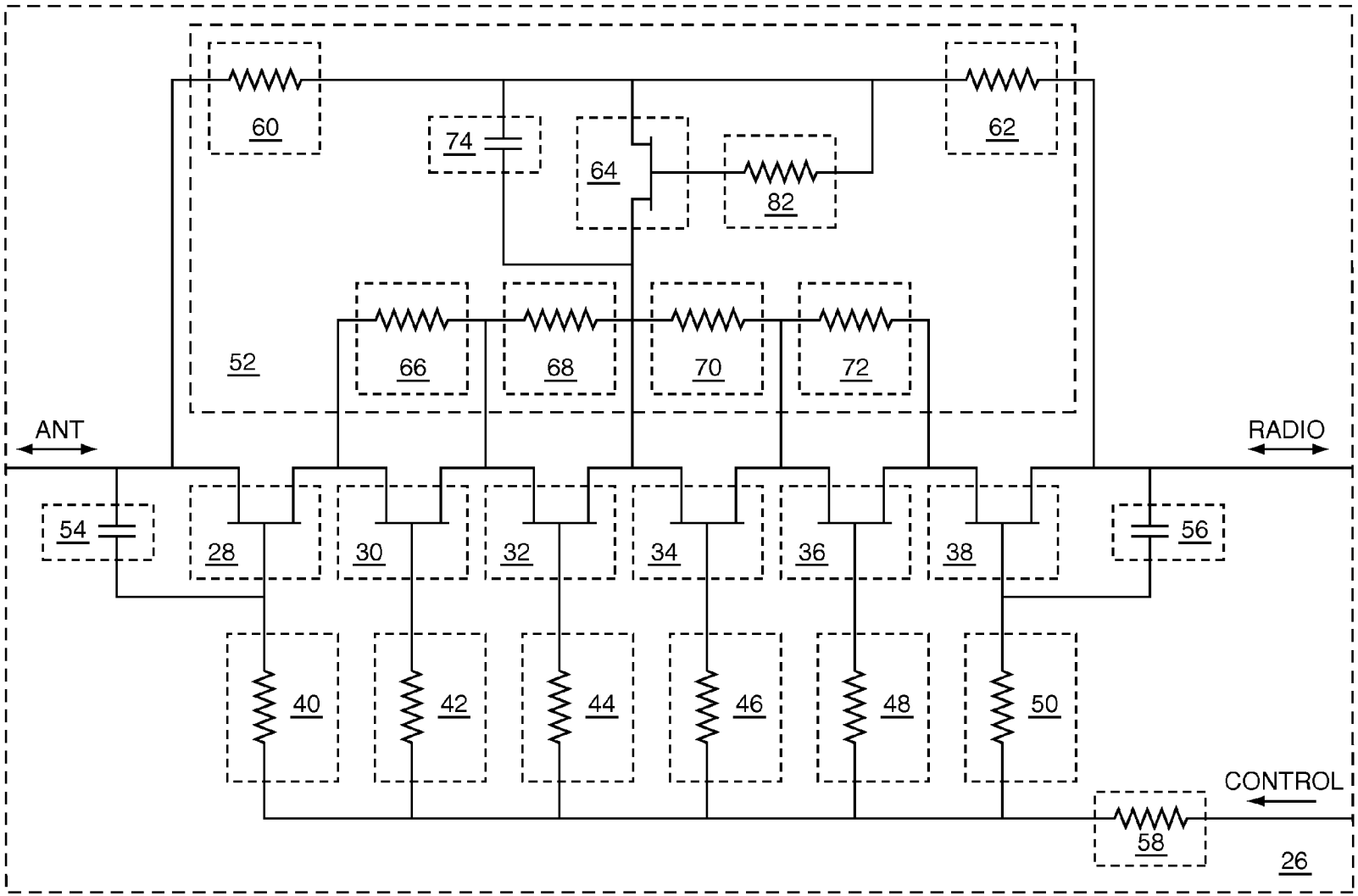

FIG. 18 shows the current source of FIG. 17 as a current source transistor element, the current source control network as a resistive element, and the first RF bypass network as a capacitive element.

Figure 19:
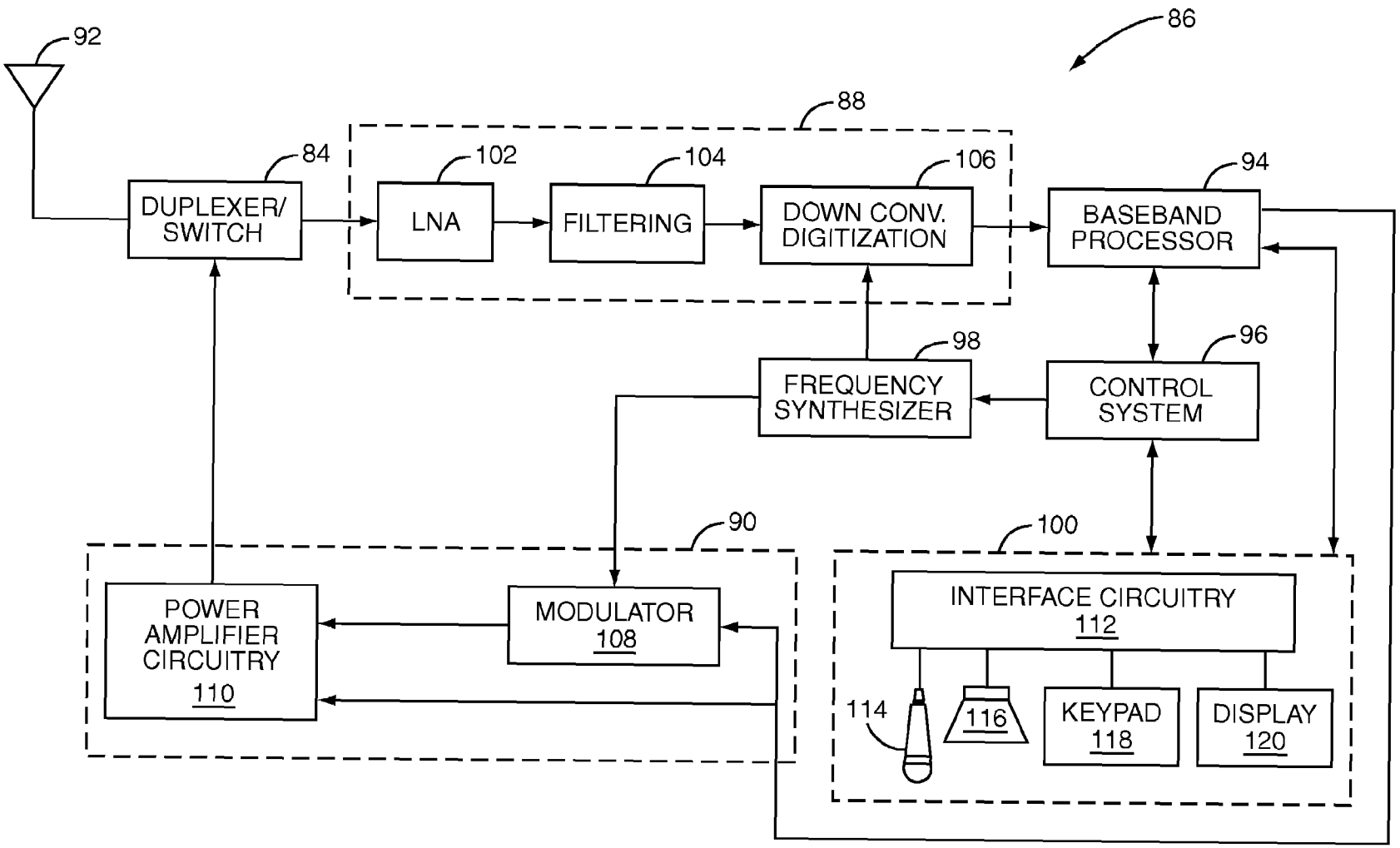

FIG. 19 shows an application example of the present invention used in a mobile terminal.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention is a wide dynamic range antenna switch that, when disabled, has a stable input impedance over a wide power range. The wide dynamic range antenna switch includes multiple transistors, which are coupled in series, to provide a main signal path between an antenna connection and a radio connection. DC bias signals are provided to each of the transistors to ensure than when the antenna switch is disabled, the input impedance is stable. A control input, which may operate with low voltage control signals, enables or disables the antenna switch. The antenna switch may be coupled with other antenna switches in a communications system with multiple transceivers sharing a common antenna, and with a wide range of transmitter output power levels. Different embodiments of the present invention provide different DC bias circuit architectures. In certain embodiments of the present invention, the antenna switch is symmetrical so that the antenna connection and the radio connection are interchangeable.

Figure 1:
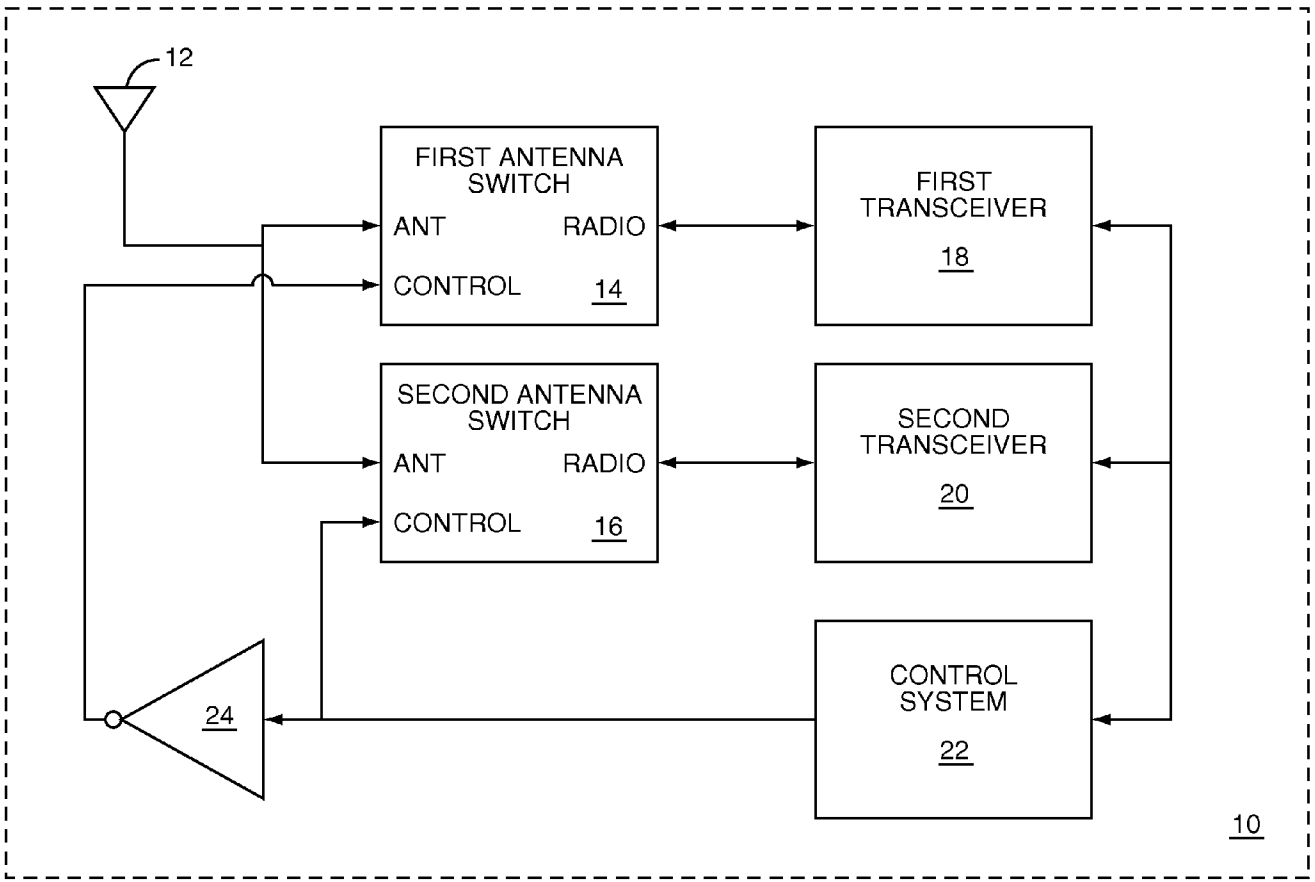
FIG. 1 PRIOR ART
Figure 2:
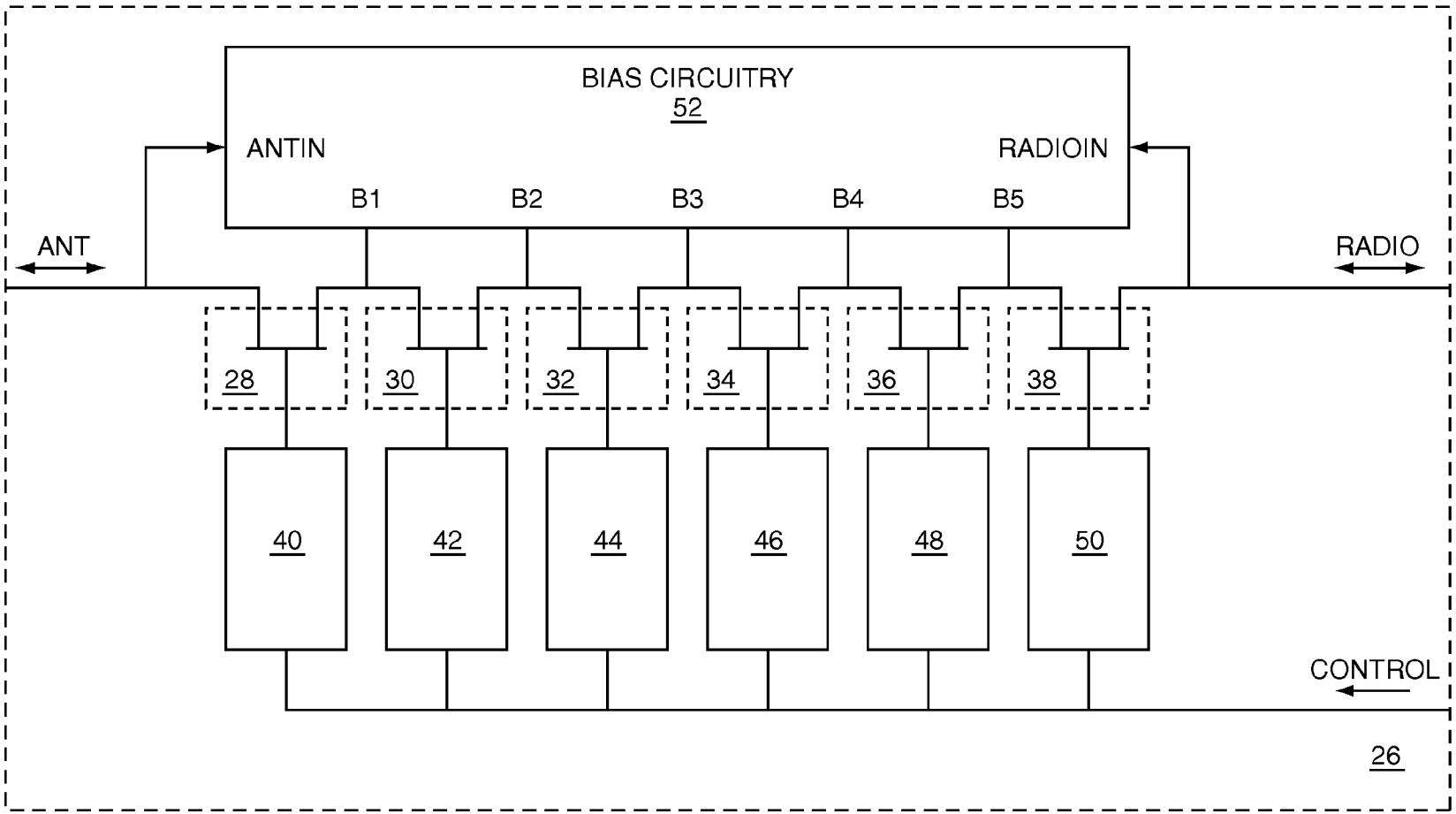

FIG. 2 shows a wide dynamic range RF antenna switch 26. A first transistor element 28, a second transistor element 30, a third transistor element 32, a fourth transistor element 34, a fifth transistor element 36, and a sixth transistor element 38 each have two main nodes, which are coupled in series to form the primary signal path for the antenna switch 26. The first transistor element 28 is coupled to an antenna connection node ANT, and the sixth transistor element 38 is coupled to a radio connection node RADIO. Normally, the antenna connection node ANT may be coupled to an antenna, or other common RF system connection. The radio connection node RADIO may be coupled to radio circuitry, which may include an RF transmitter, receiver, or both. In certain embodiments of the present invention, the wide dynamic range RF antenna switch 26 is symmetrical, wherein the antenna connection node ANT is interchangeable with the radio connection node RADIO. A first transistor element control network 40, a second transistor element control network 42, a third transistor element control network 44, a fourth transistor element control network 46, a fifth transistor element control network 48, and a sixth transistor element control network 50 are coupled on one side to control inputs of the first, second, third, fourth, fifth, and sixth transistor elements 28, 30, 32, 34, 36, 38, respectively, and are coupled on the other side to a common antenna control node. The common antenna control node is coupled to an antenna switch control input CONTROL, which receives a control signal to enable or disable the wide dynamic range RF antenna switch 26. Other embodiments of the present invention may use any number greater than or equal to two of series coupled transistor elements to form the primary signal path. In one embodiment of the present invention, the transistor elements 28, 30, 32, 34, 36, 38 may include pseudomorphic high electron mobility transistors (pHEMTs).

Bias circuitry 52 includes an antenna signal input ANTIN, which is coupled to the antenna connection node ANT, and receives an antenna input signal from the antenna connection node ANT, and a radio signal input RADIOIN, which is coupled to the radio connection node RADIO, and receives a radio input signal from the radio connection node RADIO. The bias circuitry 52 uses the antenna input signal and the radio input signal to provide five bias signals, which are provided on a first bias output B1, which is coupled to main nodes of the first and second transistor elements 28, 30, a second bias output B2, which is coupled to main nodes of the second and third transistor elements 30, 32, a third bias output B3, which is coupled to main nodes of the third and fourth transistor elements 32, 34, a fourth bias output B4, which is coupled to main nodes of the fourth and fifth transistor elements 34, 36, and a fifth bias output B5, which is coupled to main nodes of the fifth and sixth transistor elements 36, 38. If the wide dynamic range RF antenna switch 26 is disabled, five bias signals B1, B2, B3, B4, B5 are provided by dividing differences between the antenna signal input ANTIN and the radio input signal RADIOIN. In an exemplary embodiment of the present invention, the voltage at the radio connection node RADIO may be approximately 2.5 volts DC, the control signal may be zero volts, and the antenna input signal may be a +20 dbm RF signal with a 2.5 volt DC offset. The difference between the antenna input signal and the signal from the radio connection node RADIO is the +20 dbm RF signal, which is divided equally across the transistor elements 28, 30, 32, 34, 36, 38; however, each of the transistor elements 28, 30, 32, 34, 36, 38 receives 2.5 volts of DC bias, which deliberately disables each of the transistor elements 28, 30, 32, 34, 36, 38.

Figure 3:
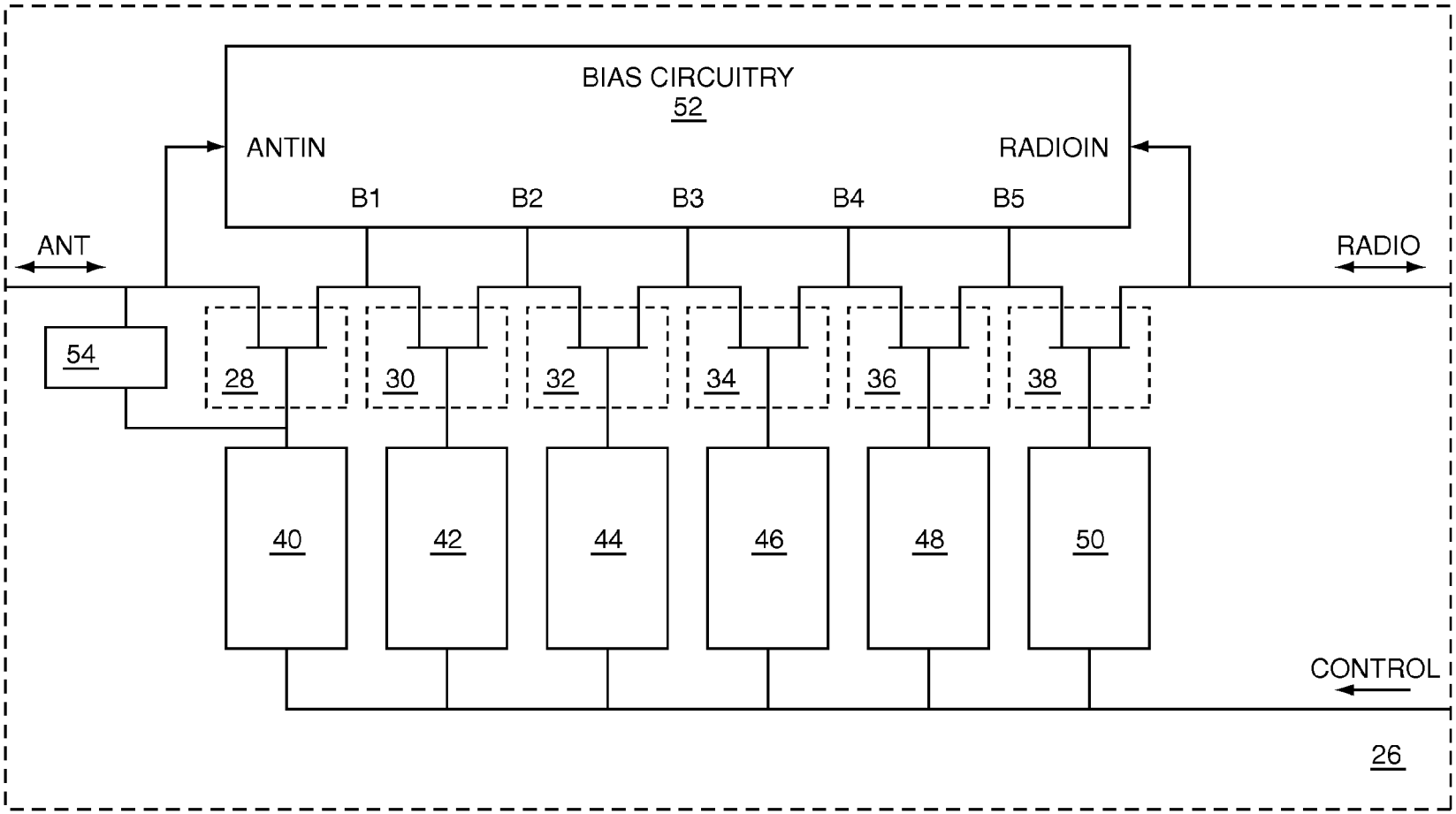

FIG. 3 adds an antenna side self-biasing network 54 to the wide dynamic range RF antenna switch 26 of FIG. 2. The antenna side self-biasing network 54 is coupled between the antenna connection node ANT and the control input to the first transistor element 28. Without the antenna side self-biasing network 54, when the wide dynamic range RF antenna switch 26 is disabled and the antenna input signal is large, threshold voltages of some of the transistor elements 28, 30, 32, 34, 36, 38 closer to the antenna connection node ANT may be exceeded, thereby causing some of the transistor elements 28, 30, 32, 34, 36, 38 to slightly enable and disable causing input impedance variations. These input impedance variations may cause intermodulation distortion of received signals when in the presence of interference signals. The antenna side self-biasing network 54 provides non-symmetrical behavior to the slightly enabling and disabling behavior of some of the transistor elements 28, 30, 32, 34, 36, 38, which extracts a DC component from the antenna input signal, thereby driving the DC bias of some of the transistor elements 28, 30, 32, 34, 36, 38 closer to the radio connection node RADIO deeper in the disabled direction, which provides a stable input impedance. In one embodiment of the present invention, the antenna input signal may be a +33 dbm RF signal.

Figure 4:
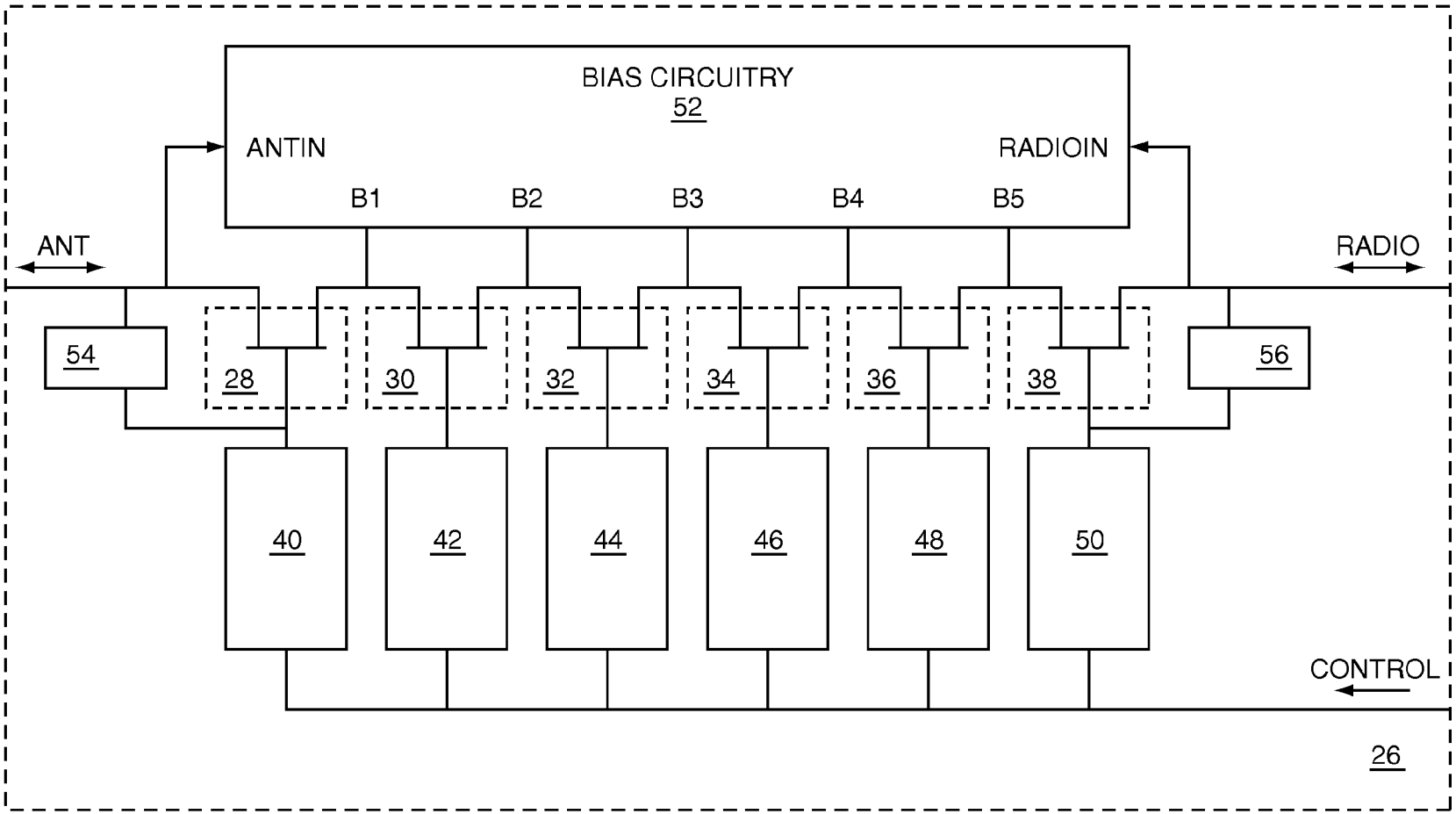

FIG. 4 adds a radio side self-biasing network 56 to the wide dynamic range RF antenna switch 26 of FIG. 3. The radio side self-biasing network 56 is coupled between the radio connection node RADIO and the control input to the sixth transistor element 38. Having self-biasing networks 54, 56 on both sides of the wide dynamic range RF antenna switch 26 provides symmetry and may allow the radio connection node RADIO to be interchangeable with the antenna connection node ANT.

Figure 5:
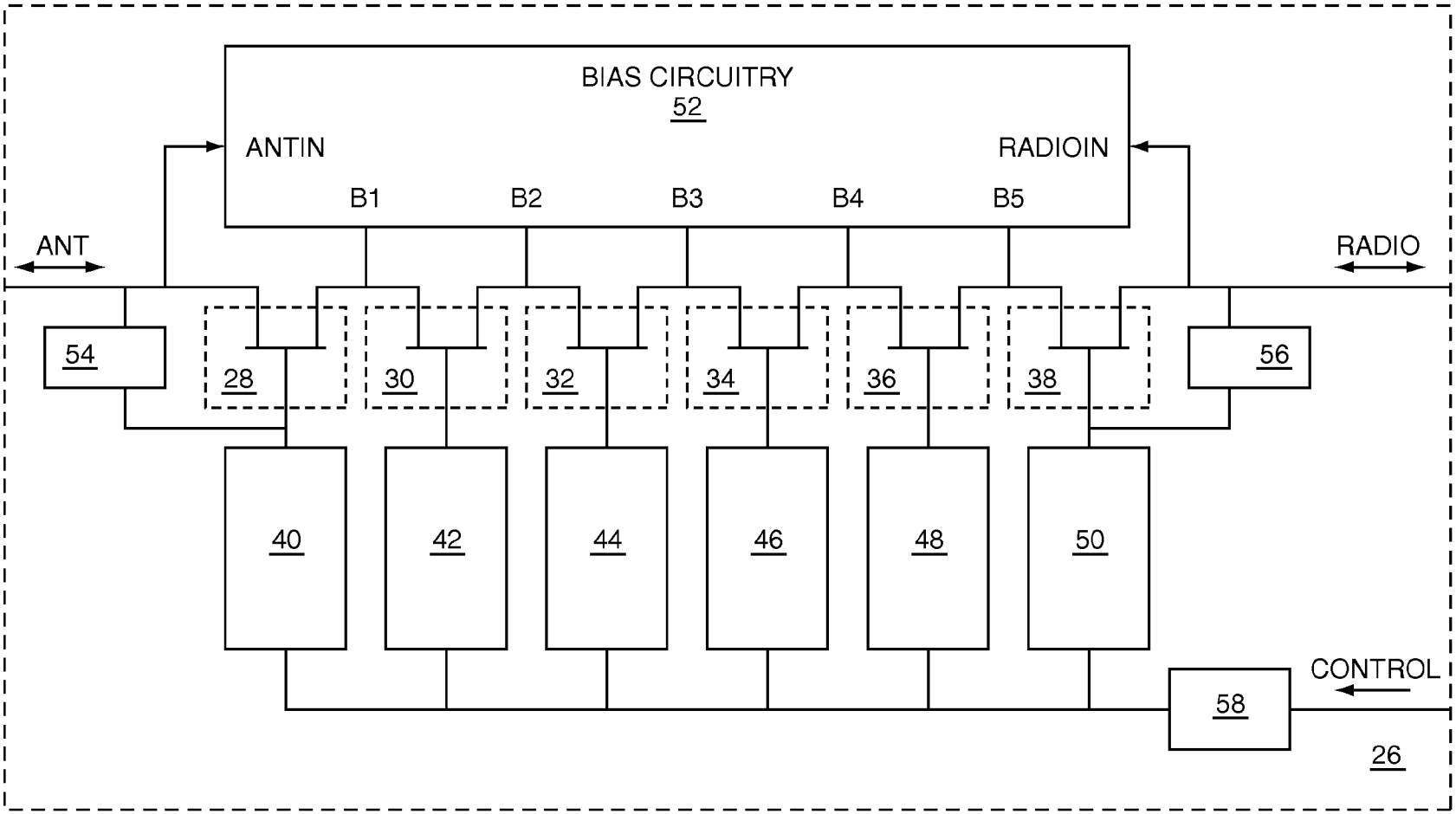

FIG. 5 adds a common control network 58 to the wide dynamic range RF antenna switch 26 of FIG. 4. The common control network 58 is coupled between the common antenna control node and the antenna switch control input CONTROL. The common control network 58 may provide some isolation between the transistor elements 28, 30, 32, 34, 36, 38 and the antenna switch control input CONTROL.

Figure 6:
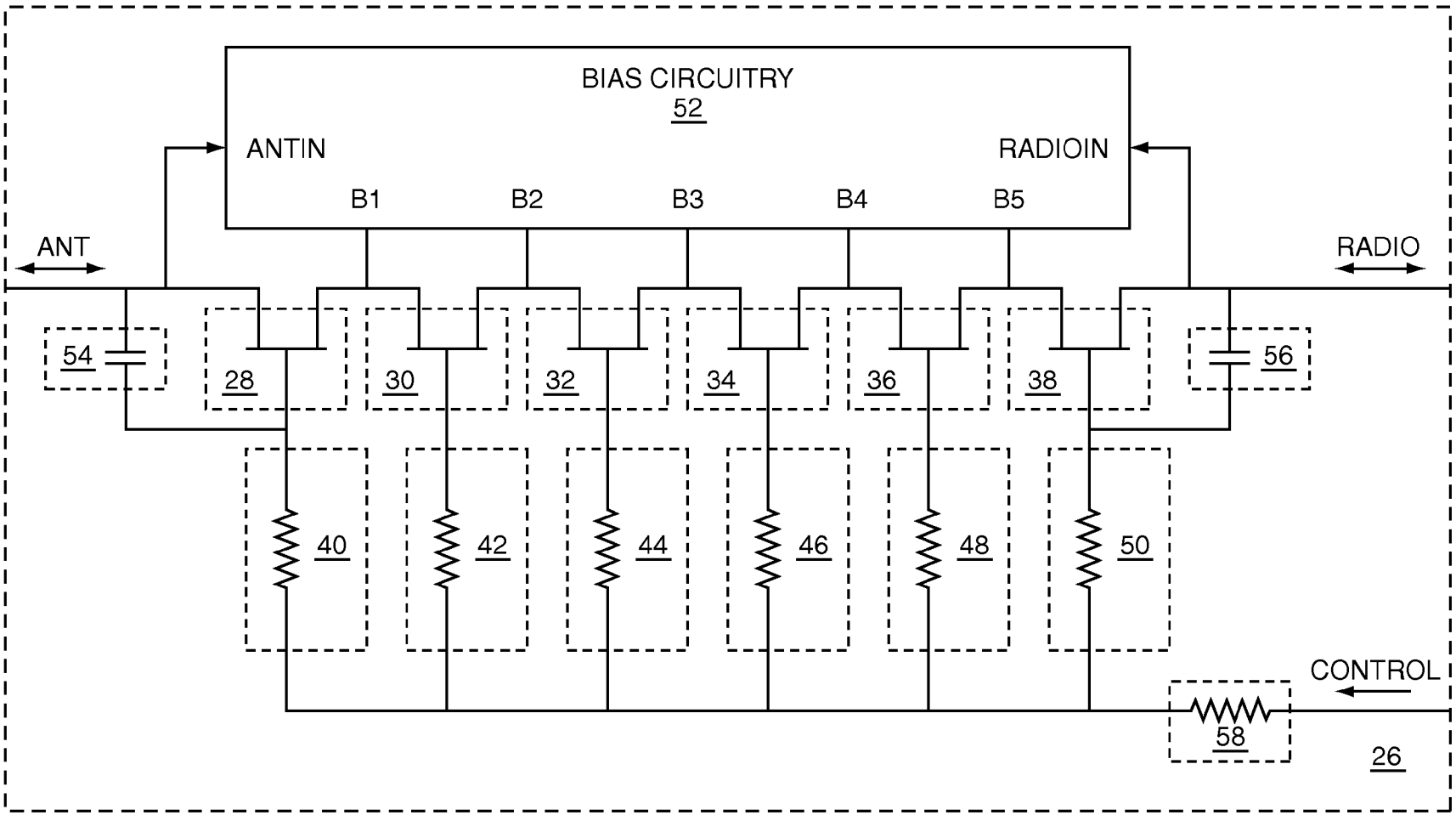
FIG. 6 shows details of the wide dynamic range RF antenna switch of FIG. 5.

FIG. 6 shows one configuration of the wide dynamic range RF antenna switch 26 of FIG. 5. The transistor element control networks 40, 42, 44, 46, 48, 50, and the common control network 58 may include resistive elements. The self-biasing networks 54, 56 may include capacitive elements.

Figure 7:
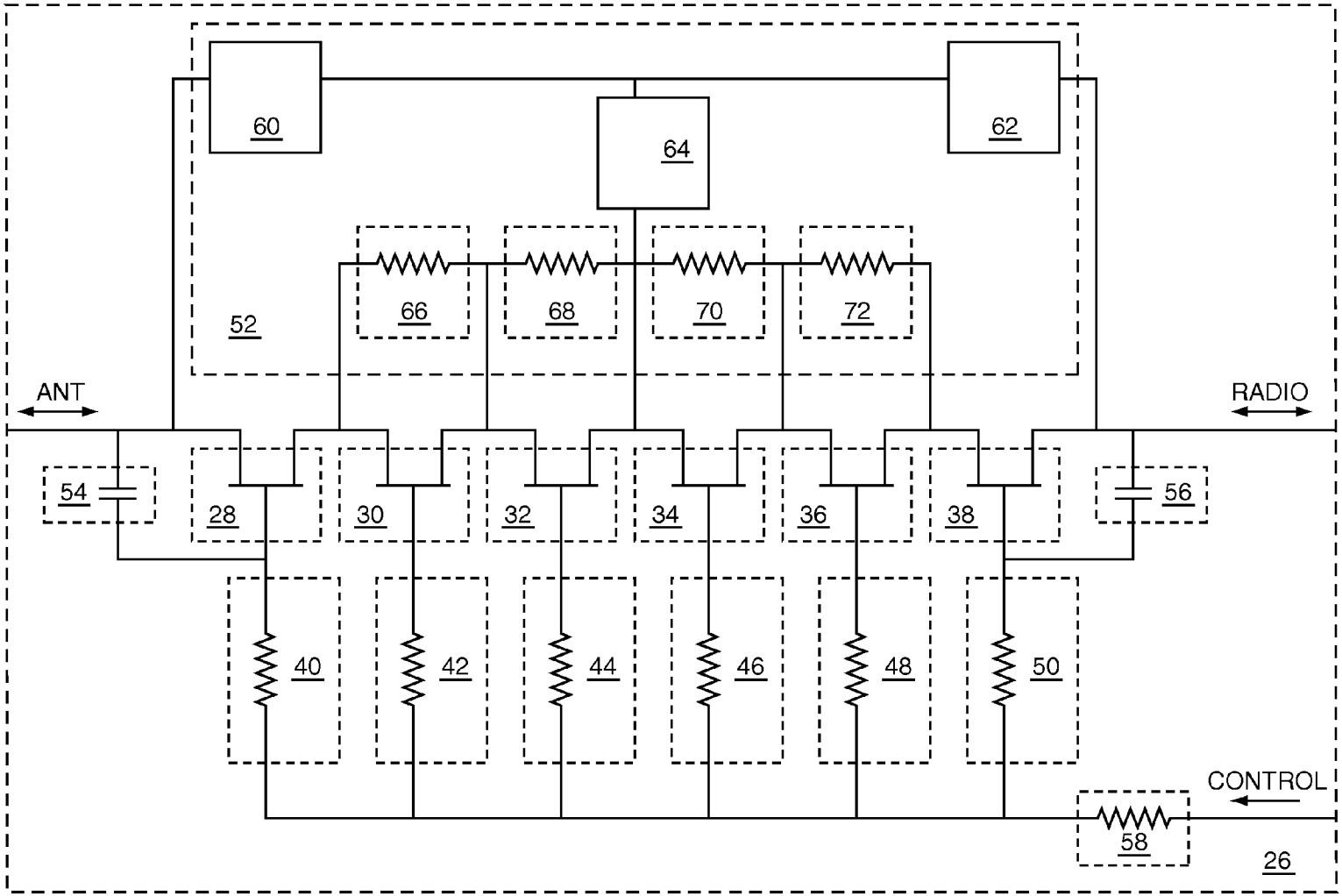
FIG. 7 shows a block representation of the present invention wherein the bias circuitry includes a first bias circuit, a first bias network, a second bias network, a third bias network, a fourth bias network, a fifth bias network, and a sixth bias network.

FIG. 7 shows a block representation of the present invention, wherein the bias circuitry 52 includes a first bias network 60, a second bias network 62, a first bias circuit 64, a third bias network 66, a fourth bias network 68, a fifth bias network 70, and a sixth bias network 72. The first bias network 60 is coupled between the antenna connection node ANT and the second bias network 62, which is coupled to the radio connection node RADIO to create a divided antenna signal. The first bias circuit 64 is coupled to the first and second bias networks 60, 62 to receive the divided antenna signal. The first bias circuit 64 conditions the divided antenna signal, which is then provided to the third, fourth, fifth, and sixth bias networks 66, 68, 70, 72. The third, fourth, fifth, and sixth bias networks 66, 68, 70, 72 are coupled to and provide bias signals to the transistor elements 28, 30, 32, 34, 36, 38. In one embodiment of the present invention, the first bias circuit 64 is substantially a short circuit. In another embodiment of the present invention, the first bias circuit 64 may include a resistive element. The value of the resistive element may be low enough to effectively provide DC biasing from the divided antenna signal in the presence of small input signals, but high enough to not degrade self-biasing in the presence of large input signals. In an exemplary embodiment of the present invention, the value of the resistive element may be approximately 140,000 ohms.

FIG. 8 shows a first embodiment of the wide dynamic range RF antenna switch 26 of FIG. 7. The first and second bias networks 60, 62, and the first bias circuit 64 may include resistive elements.

FIG. 9 shows a second embodiment of the present invention, wherein the first bias circuit 64 of FIG. 7 includes a diode element. The diode element provides DC biasing from the divided antenna signal in the presence of small input signals, but may become reversed biased to not degrade self-biasing in the presence of large input signals. The anode of the diode element is coupled to the first and second bias networks 60, 62. The cathode of the diode element is coupled to the third, fourth, fifth, and sixth bias networks 66, 68, 70, 72.

FIG. 10 adds a first RF bypass network 74 to the second embodiment of the present invention shown in FIG. 9. The first RF bypass network 74 is coupled across the first bias circuit 64 to bypass any RF signals that may develop across the first bias circuit 64.

FIG. 11 shows one embodiment of the present invention shown in FIG. 10. The first RF bypass network 74 may include a capacitive element.

FIG. 12 shows a third embodiment of the present invention wherein the first bias circuit 64 of FIG. 7 includes a bias switching transistor element and a bias switching transistor control network 76. The bias switching transistor control network 76 is coupled between a bias mode input MODE and a control input to the bias switching transistor element. The bias mode input MODE receives a bias mode control signal, which enables or disables the bias switching transistor element. When enabled, as in the presence of small input signals, the bias switching transistor element provides DC biasing to the third, fourth, fifth, and sixth bias networks 66, 68, 70, 72. When disabled, as in the presence of large input signals, the bias switching transistor element presents substantially an open circuit to the third, fourth, fifth, and sixth bias networks 66, 68, 70, 72, which does not interfere with self-biasing.

FIG. 13 adds the first RF bypass network 74 to the third embodiment of the present invention shown in FIG. 12 to bypass any RF signals that may develop across the first bias circuit 64.

FIG. 14 adds a second RF bypass network 78 and a third RF bypass network 80 to the third embodiment of the present invention shown in FIG. 13 to bypass any RF signals at the control input to the bias switching transistor element. The second and third RF bypass networks 78, 80 are coupled in series across the bias switching transistor element. The series coupled connection of the second and third RF bypass networks 78, 80 are coupled to the control input to the bias switching transistor element 64.

FIG. 15 shows one embodiment of the present invention shown in FIG. 14. The first, second, and third RF bypass networks 74, 78, 80 may include capacitive elements. The bias switching transistor control network 76 may include a resistive element.

FIG. 16 shows a fourth embodiment of the present invention wherein the first bias circuit 64 of FIG. 7 includes a current source, and a current source control network 82. The current source control network 82 is coupled to the current source to provide a current setpoint. The current source provides DC biasing to the third, fourth, fifth, and sixth bias networks 66, 68, 70, 72, and since the output impedance of a current source is large, the current source does not interfere with self-biasing.

FIG. 17 adds the first RF bypass network 74 to the fourth embodiment of the present invention shown in FIG. 16.

FIG. 18 shows one embodiment of the present invention shown in FIG. 17. The current source may include a current source transistor element. The current source control network 82 may include a resistive element. The first RF bypass network 74 may include a capacitive element.

An application example of a wide dynamic range RF antenna switch 26 is its use in duplexer or switch circuitry 84 in a mobile terminal 86. The basic architecture of the mobile terminal 86 is represented in FIG. 19 and may include a receiver front end 88, a radio frequency transmitter section 90, an antenna 92, the duplexer or switch circuitry 84, a baseband processor 94, a control system 96, a frequency synthesizer 98, and an interface 100. The receiver front end 88 receives information bearing radio frequency signals from one or more remote transmitters provided by a base station. A low noise amplifier (LNA) 102 amplifies the signal. A filter circuit 104 minimizes broadband interference in the received signal, while downconversion and digitization circuitry 106 downconverts the filtered, received signal to an intermediate or baseband frequency signal, which is then digitized into one or more digital streams. The receiver front end 88 typically uses one or more mixing frequencies generated by the frequency synthesizer 98. The baseband processor 94 processes the digitized received signal to extract the information or data bits conveyed in the received signal. This processing typically comprises demodulation, decoding, and error correction operations. As such, the baseband processor 94 is generally implemented in one or more digital signal processors (DSPs).

On the transmit side, the baseband processor 94 receives digitized data, which may represent voice, data, or control information, from the control system 96, which it encodes for transmission. The encoded data is output to the transmitter 90, where it is used by a modulator 108 to modulate a carrier signal that is at a desired transmit frequency. Power amplifier circuitry 110 amplifies the modulated carrier signal to a level appropriate for transmission, and delivers the amplified and modulated carrier signal to the antenna 92 through the duplexer or switch circuitry 84.

A user may interact with the mobile terminal 86 via the interface 100, which may include interface circuitry 112 associated with a microphone 114, a speaker 116, a keypad 118, and a display 120. The interface circuitry 112 typically includes analog-to-digital converters, digital-to-analog converters, amplifiers, and the like. Additionally, it may include a voice encoder/decoder, in which case it may communicate directly with the baseband processor 94. The microphone 114 will typically convert audio input, such as the user's voice, into an electrical signal, which is then digitized and passed directly or indirectly to the baseband processor 94. Audio information encoded in the received signal is recovered by the baseband processor 94, and converted by the interface circuitry 112 into an analog signal suitable for driving the speaker 116. The keypad 118 and display 120 enable the user to interact with the mobile terminal 86, input numbers to be dialed, address book information, or the like, as well as monitor call progress information.

Those skilled in the art will recognize improvements and modifications to the preferred embodiments of the present invention. All such improvements and modifications are considered within the scope of the concepts disclosed herein and the claims that follow.

What is claimed is:

1. A radio frequency (RF) antenna switch comprising:

a plurality of switching transistor elements coupled in series to form a switching transistor element chain comprising:

an antenna connection node and a radio connection node at either end of the switching transistor element chain; and at least one interconnection node where any two of the switching transistor elements are coupled; and bias circuitry comprising:

a first bias network and a second bias network, which are coupled in series between the antenna connection node and the radio connection node, and provide an intermediate node between the first bias network and the second bias network; and a bias conditioning circuit coupled between the intermediate node and one of the at least one interconnection nodes where any two of the switching transistor elements are coupled, wherein the bias circuitry is adapted to provide at least one signal path between the intermediate node and the at least one interconnection node where any two of the switching transistor elements are coupled in at least a first mode of operation, and at least one bias signal provided to the at least one interconnection node where any two of the switching transistor elements are coupled is based on an antenna signal at the antenna connection node and a radio signal at the radio connection node.

2. The RF antenna switch of claim 1 wherein:

the RF antenna switch is adapted to receive an RF antenna switch control signal that selects one of the first mode and a second mode of operation; and each switching transistor element further comprises a transistor element control input adapted to:

when operating in the first mode, provide a high impedance path through the each switching transistor element; and when operating in the second mode, provide a low impedance path through the each switching transistor element.

3. The RF antenna switch of claim 1 wherein:

the plurality of switching transistor elements further comprise a plurality of transistor element control inputs; and the RF antenna switch further comprises a plurality of switching transistor element control networks coupled to the plurality of transistor element control inputs, wherein the plurality of transistor element control inputs are adapted to receive an RF antenna switch control signal.

4. The RF antenna switch of claim 3 wherein the plurality of switching transistor element control networks further comprise a plurality of resistive elements.

5. The RF antenna switch of claim 1 wherein:

a switching transistor element that is coupled to the antenna connection node further comprises a transistor element control input; and the RF antenna switch further comprises an antenna side phase shift network coupled between the antenna connection node and the transistor element control input.

6. The RF antenna switch of claim 5 wherein the antenna side phase shift network further comprises a capacitive element.

7. The RF antenna switch of claim 1 wherein:

a switching transistor element that is coupled to the radio connection node further comprises a transistor element control input; and the RF antenna switch further comprises a radio side phase shift network coupled between the radio connection node and the transistor element control input.

8. The RF antenna switch of claim 7 wherein the radio side phase shift network further comprises a capacitive element.

9. The RF antenna switch of claim 1 wherein the plurality of switching transistor elements consists of two switching transistor elements.

10. The RF antenna switch of claim 1 wherein:

the plurality of switching transistor elements consists of three switching transistor elements; and the bias circuitry further comprises a third bias network coupled between two of the at least one interconnection nodes where any two of the switching transistor elements are coupled.

11. The RF antenna switch of claim 1 wherein the bias circuitry further comprises a plurality of bias networks coupled in series to form a bias networks chain comprising a plurality of bias connection nodes where any two of the plurality of bias networks are coupled, wherein the plurality of bias connection nodes are coupled to the at least one interconnection node where any two of the switching transistor elements are coupled.

12. The RF antenna switch of claim 11 wherein the plurality of bias networks further comprise a plurality of resistive elements.

13. The RF antenna switch of claim 1 wherein the bias conditioning circuit further comprises a substantially short circuit.

14. The RF antenna switch of claim 1 wherein the bias conditioning circuit further comprises a resistive element.

15. The RF antenna switch of claim 1 wherein the bias conditioning circuit further comprises a diode element, wherein an anode of the diode element is coupled to the intermediate node, and a cathode of the diode element is coupled to the one of the at least one interconnection nodes where any two of the switching transistor elements are coupled.

16. The RF antenna switch of claim 1 operating in one of the first mode and a second mode of operation, wherein the bias conditioning circuit further comprises a bias switching transistor element comprising a first bias switching transistor element main node coupled to the intermediate node, a second bias switching transistor element main node coupled to the one of the at least one interconnection nodes where any two of the switching transistor elements are coupled, and a bias switching transistor element control input adapted to:

when operating in the first mode, provide a low impedance path between the first bias switching transistor element main node and the second bias switching transistor element main node; and when operating in the second mode, provide a high impedance path between the first bias switching transistor element main node and the second bias switching transistor element main node.

17. The RF antenna switch of claim 1 wherein the bias conditioning circuit further comprises a current source, wherein a current source input of the current source is coupled to the intermediate node and a current source output of the current source is coupled to the one of the at least one interconnection nodes where any two of the switching transistor elements are coupled.

18. The RF antenna switch of claim 1 wherein the first bias network further comprises a first resistive element, and the second bias network further comprises a second resistive element.

19. The RF antenna switch of claim 1 wherein the each transistor element further comprises a pseudomorphic high electron mobility transistor (pHEMT).

20. The RF antenna switch of claim 1 wherein the antenna connection node is interchangeable with the radio connection node.

* * * * *